US008974728B2

(12) United States Patent
Feng et al.

(10) Patent No.: US 8,974,728 B2
(45) **Date of Patent: *Mar. 10, 2015**

(54) HOT-DIP CAST ALUMINUM ALLOY CONTAINING AL-ZN-SI-MG-RE-TI-NI AND PREPARATION METHOD THEREOF

(75) Inventors: Lixin Feng, Jiangsu (CN); Minyan Zhang, Jiangsu (CN); Qiang Miao, Jiangsu (CN)

(73) Assignee: Jiangsu Linlong New Materials Co., Ltd., Rongdong Village, Yuqi Town, Huishan, Wuxi, Jiangsu (CN)

( * ) Notice: Subject to any disclaimer, the term of this patent is extended or adjusted under 35 U.S.C. 154(b) by 982 days.

This patent is subject to a terminal disclaimer.

(21) Appl. No.: 13/127,237

(22) PCT Filed: Mar. 31, 2010

(86) PCT No.: PCT/CN2010/071482

§ 371 (c)(1), (2), (4) Date: May 2, 2011

(87) PCT Pub. No.: WO2011/079553

PCT Pub. Date: Jul. 7, 2011

(65) Prior Publication Data

US 2011/0293467 A1 Dec. 1, 2011

(30) Foreign Application Priority Data

Nov. 19, 2009 (CN) ..... 2009 1 0223768

(51) Int. Cl.
*C22C 18/04* (2006.01)
*C22C 21/10* (2006.01)

(52) U.S. Cl.
USPC ..... 420/519; 420/541

(58) Field of Classification Search
USPC ..... 420/519, 541; 164/57.1
See application file for complete search history.

(56) References Cited

U.S. PATENT DOCUMENTS 6,564,604 B2 * 5/2003 Kefferstein et al. ..... 72/47
2007/0256808 A1 * 11/2007 Fleischanderl et al. ..... 164/72

FOREIGN PATENT DOCUMENTS

WO PCT/CN2010/071482 8/2010

* cited by examiner

*Primary Examiner* — George Wyszomierski
*Assistant Examiner* — Janelle Morillo
(74) *Attorney, Agent, or Firm* — Tianhua Gu; Global IP Services

(57) ABSTRACT

The invention relates to hot-dip cast aluminum alloy for anti-corrosion treatment on engineering parts resistant to marine climate and a preparation method thereof, wherein said cast aluminum alloy contains Al, Zn, Si, Mg, RE, Ti, Ni and nanometer oxide particle reinforcing agent, said nanometer oxide particle reinforcing agent is selected from one or two of $TiO_2$ and $CeO_2$, the mass percentage of the components is as follows: Zn: 35-58%, Si: 0.3-4.0%, Mg: 0.1-5.0%, RE: 0.02-1.0%, Ti: 0.01-0.5%, Ni: 0.1-3.0%, and the total content of the nanometer oxide particle reinforcing agent: 0.01-1.0%; and the balance consists of Al and unavoidable impurities. The coating using cast aluminum alloy prepared by the invention has sufficient corrosion resistance and scour resistance in marine climate.

12 Claims, No Drawings

HOT-DIP CAST ALUMINUM ALLOY CONTAINING AL-ZN-SI-MG-RE-TI-NI AND PREPARATION METHOD THEREOF

CROSS REFERENCE TO RELATED PATENT APPLICATION

The present application is the US national stage of PCT/CN2010/071482 filed on Mar. 31, 2010, which claims the priority of the Chinese patent application No. 200910223768.4 filed on Nov. 19, 2009, which application is incorporated herein by reference.

FIELD OF INVENTION

The invention relates to hot-dip cast aluminum alloy containing Al—Zn—Si—Mg—RE—Ti—Ni and a preparation method thereof, in particular to hot-dip cast aluminum alloy containing Al—Zn—Mg—RE—Ti—Ni for anticorrosion treatment on engineering parts resistant to marine climate and a preparation method thereof.

Background of the Invention

With the rapid growth of science and technology, more and more engineering equipment is applied in offshore water and ocean, but its service environment is generally higher than level C5 according to ISO 9225 environmental assessment standard and belongs to extremely harsh environment with rainy, high temperature, salt misty and strong wind. Comprehensive actions or strong atmospheric corrosion, electrochemical corrosion and current scour corrosion on exposed parts cause service lives of various steel structures to be far shorter than that in the common inland outdoor environment.

For instance, presently, wind energy has become a renewable and clean energy resource processing the mature technology and conditions of scale development. However, because wind turbines utilize wind energy to generate electricity, and there is rich wind resources at coast lines and offshore waters, most wind power plants are located at coastal or offshore waters. Wind turbines service in marine climate with common protective measures are usually seriously corroded within only a couple of months because the external members, such as engine rooms, engine covers, tower structures, etc., are directly exposed in extremely corrosive atmosphere. Therefore, the problem urgent to be solved is corrosion resistance of the coating for anticorrosion treatment on engineering parts resistant to marine climate.

SUMMARY OF THE INVENTION

In view of the problems of the prior art, the invention provides hot-dip cast aluminum alloy for anticorrosion treatment on engineering parts resistant to marine climate and a preparation method thereof.

In the hot-dip cast aluminum alloy for anticorrosion treatment on engineering parts resistant to marine climate provided by the invention, said cast aluminum alloy contains Al, Zn, Si, Mg, RE, Ti, Ni and nanometer oxide particle reinforcing agent, said nanometer oxide particle reinforcing agent is selected from one or two of $TiO_2$ and $CeO_2$, the mass percentage of the components is as follows: Zn: 35-58%, Si: 0.3-4.0%, Mg: 0.1-5.0%, RE: 0.02-1.0%, Ti: 0.01-0.5%, Ni: 0.1-3.0%, and the total content of the nanometer oxide particle reinforcing agent: 0.01-1.0%; and the balance consists of Al and unavoidable impurities.

Wherein, RE is any one of or several rare earth elements.

Preferably, if said nanometer oxide particles are spherical particles, the specific surface and the average particle size of the spherical particles satisfy the following relation expression:

$$\text{Specific surface} = \frac{6}{\rho \cdot D}(\text{m}^2/\text{g})$$

Where D is the average particle size; and

ρ is density.

If the shape of said nanometer oxide particles is more complex than common spherical particles, the performance and the effect of the coating is more perfect, and thus, the more prefer nanometer oxide particles of the invention have greater specific surface than the calculated value according to the above expression:

Preferably, when the nanometer oxide particles are $TiO_2$, the average particle size of said $TiO_2$ is 15-60 nm.

Preferably, when the nanometer oxide particles are $TiO_2$, the specific surface of said $TiO_2$ is 20-90 $m^2/g$.

Preferably, when the nanometer oxide particles are $CeO_2$, the average particle size of said $CeO_2$ is 25-70 nm.

Preferably, when the nanometer oxide particles are $CeO_2$, the specific surface of said $CeO_2$ is 10-80 $m^2/g$.

Preferably, when the nanometer oxide particle reinforcing agent consists of $TiO_2$ and $CeO_2$, the mass ratio of $TiO_2$ to $CeO_2$ is 1: (1-3).

More preferably, the mass ratio of $TiO_2$ to $CeO_2$ is 1:2.

Preferably, the mass percentage of said components is as follows: Zn: 41-51%, Si: 1-3.2%, Mg: 1.8-4%, RE: 0.05-0.8%, Ti: 0.05-0.35%, Ni: 1.5-2.6%, and the total content of the nanometer oxide particle reinforcing agent: 0.05-0.8%.

Furthermore, the invention provides a method for preparing said hot-dip cast aluminum alloy, which comprises the steps of preparing materials according to the mass percentage of Al, Zn, Si, Mg, RE, Ti, Ni and the nanometer oxide particle reinforcing agent, firstly heating Al to 700-750° C. and melting Al in vacuum or protective atmosphere, stirring evenly, and adding Si; raising temperature to 800-840° C. and then adding RE; raising temperature to 830-850° C. and then adding Zn; raising temperature to 850-880° C. and then adding Ni and Ti; cooling to 750-700° C. and then adding Mg and the nanometer oxide particle reinforcing agent; and cooling to 700-650° C., standing for 10-35 minutes after stirring evenly, and forming ingots by casting or die casting.

Preferably, the heating rate is 10-40° C./minute during said heating process, and the cooling rate is 20-60° C./minute during said cooling process.

In the hot-dip cast aluminum alloy resistant to marine climate corrosion provided by the invention, metal Al can resist atmospheric corrosion, a layer of dense oxide film can be rapidly formed on the surface of AL, and Al has capacity of rapid damage self-repairing; and Zn has lower electrode potential acting as a sacrificial anode and thus enables steel to have sufficient capacity of resisting electrochemical corrosion.

However, if the content of Zn is over high, the toughness and the hardness of the coating will be decreased resulting in the reduction of resistance of the coating to atmospheric corrosion and current scour resistance. In order to solve the problem, in the invention, a certain amount of nanometer oxide particle reinforcing agent is added to greatly fine particles of the coating, thereby improving the capacity of the coating resisting to atmospheric corrosion, electrochemical corrosion and current scour resistance and significantly improving the strength and the hardness of the coating so as to endow the coating with better current scour resistance. Furthermore, through a larger number of repeated experiments and selections, the performance of the coating can be remarkably improved by selecting proper particle size and specific surface of the nanometer oxide particle reinforcing agent. Moreover, the particle size of the nanometer oxide particle reinforcing agent being within the range of the invention can improve the abrasion resistance index of the coating, and the specific surface of the nanometer oxide particle reinforcing agent being within the range of the invention can greatly increase the aggregation degree of the alloy, and thereby the scour resistance of the alloy coasting is remarkably improved.

On this basis, microalloy elements such as Mg, Ti, Ni, etc. are added to fine particles better and further improve the toughness and the corrosion resistance of the coating, wherein Mg can improve the affinity, the corrosion resistance and the room-temperature strength of the alloy, Ti enhances the hardening constituent in the coating and has the function of solid solution to the alloy, and Ni not only has further function of solid solution to the alloy but also further improve the toughness and the stability of the alloy.

To sum up, coating employing the cast aluminum alloy prepared by the invention has sufficient corrosion resistance and scour resistance in marine climate.

In the other aspect, the invention provides a method, in which hot-dip alloy elements are added at different temperature sections to be beneficial to the improvement of the dispersion of the nanometer oxide particle reinforcing agent and the elements along with the raise of temperature, thereby improving the uniformity of the components of the coating and significantly enhancing the binding strength between the coating and a substrate.

However, if all the elements are added when the temperature of melt is over high, the coating easily shows high-alumina brittle phase, which goes against bearing contact fretting load. Therefore, in the invention, a part of hot-dip alloy elements are added at different temperature sections, then the nanometer oxide particle reinforcing agent is added after the temperature falls to a certain temperature, and the temperature is decreased and preserved for a certain time, thereby overcoming the above defect to obtain a coating with composition uniformity and better toughness.

In summary, compared with the prior art, the coating of the invention remarkably improves the performance of resisting atmospheric corrosion, electrochemical corrosion and current scour corrosion as well as the strength, the hardness and scour resistance, and the coating is firmly bounded to the substrate and totally suitable for extremely harsh environment such as marine environment, and the like. Furthermore, the invention has simplified process and can obtain a coating with composition uniformity and better toughness. In addition, main elements in the alloy, such Al, Zn, etc., are rich in nature, therefore, the invention has the advantages of low material cost, environmental protection and energy conservation. The coating using the alloy of the invention has wide adjusting range of thickness and is suitable for the treatment on parts with different sizes.

DETAILED DESCRIPTIONS OF THE INVENTION

The invention provides hot-dip cast aluminum alloy for anticorrosion treatment on engineering parts resistant to marine climate, in which said cast aluminum alloy contains Al, Zn, Si, Mg, RE, Ti, Ni and nanometer oxide particle reinforcing agent, said nanometer oxide particle reinforcing agent is selected from one or two of $TiO_2$ and $CeO_2$, the mass percentage of the components is as follows: Zn: 35-58%, Si: 0.3-4.0%, Mg: 0.1-5.0%, RE: 0.02-1.0%, Ti: 0.01-0.5%, Ni: 0.1-3.0%, and the total content of the nanometer oxide particle reinforcing agent: 0.01-1.0%; and the balance consists of Al and unavoidable impurities.

Furthermore, through a larger number of repeated experiments and selections, the performance of the coating can be remarkably improved by selecting proper particle size and specific surface of the nanometer oxide particle reinforcing agent, and if said nanometer oxide particles are spherical particles, the specific surface and the average particle size of the spherical particles satisfy the following relation expression:

$$\text{Specific surface} = \frac{6}{\rho \cdot D}(\text{m}^2/\text{g})$$

Where D is the average particle size; and

ρ is density.

Furthermore, if the shape of said nanometer oxide particles is more complex than common spherical particles, the performance and the effect of the coating is more perfect, and thus, the prefer nanometer oxide particles of the invention has greater specific surface than the calculated value according to the above expression: Preferably, when the nanometer oxide particles are $TiO_2$, the average particle size of said $TiO_2$ is 15-60 nm.

Preferably, when the nanometer oxide particles are $TiO_2$, the specific surface of said $TiO_2$ is 20-90 $m^2/g$.

Preferably, when the nanometer oxide particles are $CeO_2$, the average particle size of said $CeO_2$ is 25-70 nm.

Preferably, when the nanometer oxide particles are $CeO_2$, the specific surface of said $CeO_2$ is 10-80 $m^2/g$.

Prefer embodiments of the mass percentage of the components of the invention are hereinafter given in tables 1-3, however the contents of the components of the invention are not limited to the values in the tables, and those skilled in the art can carry out reasonable generalization and deduction on the basis of the value range listed in the tables.

It is necessary to be specifically described that although relative values of the particle size and the specific surface of the nanometer oxide particle reinforcing agent are simultaneously listed in the tables 1-3, these two conditions are not described as essential technical characteristics. As for the invention, the core content lies in obtaining the objects of fining the particles of the coating, improving the toughness and different corrosion resistances and eliminating bad effects caused by over high content of zinc by adding a certain amount of nanometer oxide particle reinforcing agent microalloy elements. On this basis, further selection of proper particle size and specific surface just enables the technical effect to be more prominent and more superior, and thus, although listed in the tables 1-3 simultaneously the two parameters are merely described as more superior conditions for more detailed technical information of the invention but not being necessary conditions.

Embodiment 1

Hot-dip cast aluminum alloy for anticorrosion treatment on engineering parts resistant to marine climate contains Al, Zn, Si, Mg, RE, Ti, Ni and $TiO_2$ nanometer oxide particle reinforcing agent, the mass percentage of the components is as follows: Zn: 35-58%, Si: 0.3-4.0%, Mg: 0.1-5.0%, RE: 0.02-1.0%, Ti: 0.01-0.5%, Ni: 0.1-3.0%, $TiO_2$ : 0.01-1.0% and Al: the balance, and unavoidable impurities. The specific mass percentages and relative parameters are shown in table 1:

TABLE 1

| Mass Percentage (%) of the Components in Total Weight and Relative Parameters | | | | | | | | | | |
|---|---|---|---|---|---|---|---|---|---|---|
| | Element | | | | | | | | | |
| | | | | | | | | $TiO_2$ | | |
| Serial number | Al | Zn | Si | Mg | RE | Ti | Ni | content | Particle size (mm) | Specific surface ($m^2/g$) |
| 1 | balance | 35 | 4.0 | 0.1 | 1.0 | 0.5 | 0.1 | 1.0 | 15 | 90 |
| 2 | balance | 36 | 3.9 | 0.3 | 0.9 | 0.48 | 0.2 | 0.9 | 18 | 85 |
| 3 | balance | 37 | 3.8 | 0.5 | 0.8 | 0.45 | 0.3 | 0.8 | 20 | 80 |
| 4 | balance | 39 | 3.6 | 0.8 | 0.6 | 0.40 | 0.5 | 0.6 | 23 | 75 |
| 5 | balance | 41 | 3.2 | 1.0 | 0.4 | 0.35 | 0.7 | 0.4 | 25 | 70 |
| 6 | balance | 43 | 2.8 | 1.3 | 0.3 | 0.30 | 1.0 | 0.3 | 28 | 65 |
| 7 | balance | 45 | 2.5 | 1.8 | 0.2 | 0.25 | 1.3 | 0.2 | 30 | 60 |
| 8 | balance | 47 | 2.2 | 2.2 | 0.15 | 0.20 | 1.5 | 0.15 | 35 | 55 |
| 9 | balance | 49 | 1.8 | 2.6 | 0.13 | 0.15 | 1.8 | 0.13 | 40 | 50 |
| 10 | balance | 51 | 1.5 | 3.0 | 0.11 | 0.1 | 2.0 | 0.11 | 45 | 45 |
| 11 | balance | 53 | 1.0 | 3.5 | 0.09 | 0.08 | 2.4 | 0.09 | 50 | 40 |
| 12 | balance | 55 | 0.8 | 4.0 | 0.07 | 0.05 | 2.6 | 0.07 | 53 | 35 |
| 13 | balance | 56 | 0.5 | 5.4 | 0.05 | 0.03 | 2.8 | 0.05 | 55 | 30 |
| 14 | balance | 57 | 0.4 | 4.8 | 0.03 | 0.02 | 2.9 | 0.03 | 58 | 25 |
| 15 | balance | 58 | 0.3 | 5.0 | 0.02 | 0.01 | 3.0 | 0.01 | 60 | 20 |

Embodiment 2

Hot-dip cast aluminum alloy for anticorrosion treatment on engineering parts resistant to marine climate contains Al, Zn, Si, Mg, RE, Ti, Ni and $CeO_2$ nanometer oxide particle reinforcing agent, Hot-dip cast aluminum alloy for anticorrosion treatment on engineering parts resistant to marine climate contains Al, Zn, Si, Mg, RE, Ti, Ni and $CeO_2$ nanometer oxide particle reinforcing agent, the mass percentage of the components is as follows: Zn: 35-58%, Si: 0.3-4.0%, Mg: 0.1-5.0%, RE: 0.02-1.0%, Ti: 0.01-0.5%, Ni: 0.1-3.0%, $CeO_2$: 0.01-1.0% and Al: the balance, and unavoidable impurities. Specific values are shown in table 2:

TABLE 2

| Mass Percentage (%) of the Components in Total Weight and Relative Parameters | | | | | | | | | | |
|---|---|---|---|---|---|---|---|---|---|---|
| | Element | | | | | | | | | |
| | | | | | | | | $CeO_2$ | | |
| Serial number | Al | Zn | Si | Mg | RE | Ti | Ni | content | Particle size (mm) | Specific surface ($m^2/g$) |
| 1 | balance | 35 | 4.0 | 0.1 | 1.0 | 0.5 | 0.1 | 1.0 | 25 | 80 |
| 2 | balance | 36 | 3.9 | 0.3 | 0.9 | 0.48 | 0.2 | 0.9 | 28 | 75 |
| 3 | balance | 37 | 3.8 | 0.5 | 0.8 | 0.45 | 0.3 | 0.8 | 30 | 70 |
| 4 | balance | 39 | 3.6 | 0.8 | 0.6 | 0.40 | 0.5 | 0.6 | 35 | 65 |
| 5 | balance | 41 | 3.2 | 1.0 | 0.4 | 0.35 | 0.7 | 0.4 | 40 | 60 |
| 6 | balance | 43 | 2.8 | 1.3 | 0.3 | 0.30 | 1.0 | 0.3 | 45 | 55 |
| 7 | balance | 45 | 2.5 | 1.8 | 0.2 | 0.25 | 1.3 | 0.2 | 50 | 50 |
| 8 | balance | 47 | 2.2 | 2.2 | 0.15 | 0.20 | 1.5 | 0.15 | 53 | 45 |
| 9 | balance | 49 | 1.8 | 2.6 | 0.13 | 0.15 | 1.8 | 0.13 | 55 | 40 |
| 10 | balance | 51 | 1.5 | 3.0 | 0.11 | 0.1 | 2.0 | 0.11 | 58 | 35 |
| 11 | balance | 53 | 1.0 | 3.5 | 0.09 | 0.08 | 2.4 | 0.09 | 60 | 30 |
| 12 | balance | 55 | 0.8 | 4.0 | 0.07 | 0.05 | 2.6 | 0.07 | 62 | 25 |
| 13 | balance | 56 | 0.5 | 4.5 | 0.05 | 0.03 | 2.8 | 0.05 | 65 | 20 |
| 14 | balance | 57 | 0.4 | 4.8 | 0.03 | 0.02 | 2.9 | 0.03 | 68 | 15 |
| 15 | balance | 58 | 0.3 | 5.0 | 0.02 | 0.01 | 3.0 | 0.01 | 70 | 10 |

Embodiment 3

Said hot-dip alloy contains Al, Zn, Si, Mg, RE, Ti, Ni and nanometer oxide particle reinforcing agent, wherein the nanometer oxide particle reinforcing agent consists of $TiO_2$ and $CeO_2$, the mass ratio of $TiO_2$ to $CeO_2$ is 1: (1-3); the mass percentage of the components is as follows: Zn: 35-58%, Si: 0.3-4.0%, Mg: 0.1-5.0%, RE: 0.02-1.0%, Ti: 0.01-0.5%, Ni: 0.1-3.0%, total content of the nanometer oxide particle reinforcing agent consisting of $TiO_2$ and $CeO_2$: 0.01-1.0%, and Al: the balance, and unavoidable impurities. Specific values are shown in table 3:

TABLE 3

Mass Percentage (%) of the Components in Total Weight and Relative Parameters

| | Element | | | | | | | | | |
|---|---|---|---|---|---|---|---|---|---|---|
| | | | | | | | | $TiO_2$ and $CeO_2$ | | |
| Serial number | Al | Zn | Si | Mg | RE | Ti | Ni | Total content ($TiO_2$:$CeO_2$) | Particle size (mm) | Specific surface ($m^2/g$) |
| 1 | balance | 35 | 4.0 | 0.1 | 1.0 | 0.5 | 0.1 | 1.0 (1:1) | 20 | 80 |
| 2 | balance | 36 | 3.9 | 0.3 | 0.9 | 0.48 | 0.2 | 0.9 (1:1.2) | 23 | 75 |
| 3 | balance | 37 | 3.8 | 0.5 | 0.8 | 0.45 | 0.3 | 0.8 (1:1.3) | 25 | 70 |
| 4 | balance | 39 | 3.6 | 0.8 | 0.6 | 0.40 | 0.5 | 0.6 (1:1.4) | 28 | 65 |
| 5 | balance | 41 | 3.2 | 1.0 | 0.4 | 0.35 | 0.7 | 0.4 (1:1.3) | 30 | 60 |
| 6 | balance | 43 | 2.8 | 1.3 | 0.3 | 0.30 | 1.0 | 0.3 (1:1.5) | 35 | 55 |
| 7 | balance | 45 | 2.5 | 1.8 | 0.2 | 0.25 | 1.3 | 0.2 (1:2) | 40 | 50 |
| 8 | balance | 47 | 2.2 | 2.2 | 0.15 | 0.20 | 1.5 | 0.15 (1:3) | 45 | 45 |
| 9 | balance | 49 | 1.8 | 2.6 | 0.13 | 0.15 | 1.8 | 0.13 (1:2) | 50 | 40 |
| 10 | balance | 51 | 1.5 | 3.0 | 0.11 | 0.1 | 2.0 | 0.11 (1:1.8) | 53 | 35 |
| 11 | balance | 53 | 1.0 | 3.5 | 0.09 | 0.08 | 2.4 | 0.09 (1:1.5) | 55 | 30 |
| 12 | balance | 55 | 0.8 | 4.0 | 0.07 | 0.05 | 2.6 | 0.07 (1:2) | 58 | 25 |
| 13 | balance | 56 | 0.5 | 4.5 | 0.05 | 0.03 | 2.8 | 0.05 (1:2.5) | 60 | 20 |
| 14 | balance | 57 | 0.4 | 4.8 | 0.03 | 0.02 | 2.9 | 0.03 (1:2.8) | 65 | 18 |
| 15 | balance | 58 | 0.3 | 5.0 | 0.02 | 0.01 | 3.0 | 0.01 (1:3) | 68 | 15 |

In embodiments 1-3, preferably, the percentage of the components in total mass is as follows: Zn: 14-51%, Si: 1-3.2%, Mg: 1.8-4%, RE: 0.05-0.8%, Ti: 0.05-0.35%, Ni: 1.5-2.6%, and total content of the nanometer oxide particle reinforcing agent: 0.05-0.8%.

More preferably, the content of said Zn is 45%, the content of said Si is 1.8%, the content of said Mg is 3.5%, the content of said RE is 0.6%, the content of said Ti is 0.25%, the content of said Ni is 2%, and total content of the nanometer oxide particle reinforcing agent: 0.2%.

In addition, a large number of experiments show that if the loose packed density of the nanometer oxide particle reinforcing agent is appropriate, the performance and the effect of the final resulting coating is more ideal.

If using $TiO_2$, preferably, the loose packed density of said $TiO_2$ is not more than 3 $g/cm^3$.

If using $CeO_2$, preferably, the loose packed density of said $CeO_2$ is not more than 5 $g/cm^3$.

If using $TiO_2$ and $CeO_2$, preferably, the average loose packed density of said $TiO_2$ and $CeO_2$ is 0.6-4.5 $g/cm^3$.

Furthermore, the invention provides a method for preparing said hot-dip alloy, which comprises preparing materials according to the mass percentage of Al, Zn, Si, Mg, RE, Ti, Ni and the nanometer oxide particle reinforcing agent, heating Al to 700-750° C. and melting Al in vacuum or protective atmosphere, stirring evenly, and adding Si; raising temperature to 800-840° C. and then adding RE; raising temperature to 830-850° C. and then adding Zn; raising temperature to 850-880° C. and then adding Ni and Ti; cooling to 750-700° C. and then adding Mg and the nanometer oxide particle reinforcing agent; and cooling to 700-650° C., standing for 10-35 minutes after stirring evenly, and forming ingots by casting or die casting.

Preferably, preparing materials according to the mass percentage of Al, Zn, Si, Mg, RE, Ti, Ni and the nanometer oxide particle reinforcing agent, heating Al to 720-750° C. and melting Al in vacuum or protective atmosphere, stirring evenly, and adding Si; raising temperature to 820-840° C. and then adding RE; raising temperature to 840-850° C. and then adding Zn; raising temperature to 860-880° C. and then adding Ni and Ti; cooling to 730-700° C. and then adding Mg and the nanometer oxide particle reinforcing agent; and cooling to 690-650° C., standing for 10-30 minutes after stirring evenly, and forming ingots by casting or die casting.

Preferably, cooling to 720-700° C. and then adding Mg and the nanometer oxide particle reinforcing agent; and finally cooling to 690-660° C. and preserve the temperature for 22-28 minutes to obtain the alloy. More preferably, cooling to 710° C. and then adding Mg and the nanometer oxide particle reinforcing agent; and finally cooling to 680° C. and preserve the temperature for 25 minutes to obtain the alloy.

During the heating process, the heating ratio is 10-40° C. per minute, and the cooling ratio is 20-60° C. per minute during the cooling process. Preferably, during the heating process, the heating ratio is 20-30° C. per minute, and the cooling ratio is 30-50° C. per minute during the cooling process.

More preferably, during the heating process, the heating ratio is 25° C. per minute, and the cooling ratio is 40° C. per minute during the cooling process.

Experimental Results of Corrosion Resistance

Embodiment 4

A key part of a certain inshore wind turbine, a flange gasket at blade root (size: Φ2200×30 mm, material: Q345), which adopted common protective coating treatment is obviously corroded after only a few months. The results of accelerated corrosion simulation experiments show that taking the hot-dip alloy of the invention as coating material to form a diffusion coating with the thickness of 150 μm and then coating a layer of polysiloxane with the thickness of 20 ∞m, the flange gasket at blade root has the durability persisting for over 20 years in seawater splashing environment.

Embodiment 5

A key part of a certain inshore wind turbine, a connecting screw bolt (size: M36×1000 m, material: 40CrNiMo), which adopted common protective coating treatment is obviously corroded after only a few months. The results of accelerated corrosion simulation experiments show that taking the hot-dip alloy of the invention as coating material to form a diffusion coating with the thickness of 100 μm and then coating a layer of polysiloxane with the thickness of 15 μm, the connecting screw bolt has the durability persisting for over 20 years.

What is claimed is:

1. A hot-dip cast aluminum alloy used for anticorrosion treatment for engineering parts resistant in marine climate comprising: the following components of Al, Zn, Si, Mg, RE, Ti, Ni and nanometer oxide particle reinforcing agent selected from one or two of $TiO_2$ and $CeO_2$, wherein mass percentages of the components are as follows: Zn 35-58%, Si 0.3-4.0%, Mg 0.1-5.0%, RE 0.02-1.0%, Ti 0.01-0.5%, Ni 0.1-3.0%, nanometer oxide particle reinforcing agent 0.01-1.0%,and the balance being Al and unavoidable impurities.

2. The hot-dip cast aluminum alloy of claim 1, wherein the nanometer oxide particle reinforcing agent is composed of spherical particles, and specific surface and average particle size of the nanometer oxide particle reinforcing agent satisfy the following relation expression:

$$\text{Specific surface } (m^2/g) = \frac{6}{\rho \cdot D}$$

where D is average particle size, and ρ is density.

3. The hot-dip cast aluminum alloy of claim 1, wherein the average particle size of said $TiO_2$ is 15-60nm.

4. The hot-dip cast aluminum of claim 1, wherein the specific surface of said $TiO_2$ is 20-90$m^2$/g.

5. The hot-dip cast aluminum alloy of claim 1, wherein the average particle size of said $CeO_2$ is 25-70nm.

6. The hot-dip cast aluminum alloy of claim 1, wherein the specific surface of said $CeO_2$ is 10-80 $m^2$/g.

7. The hot-dip cast aluminum alloy of claim 1, wherein the nanometer oxide particle reinforcing agent consists of $TiO_2$ and $CeO_2$, and the mass ratio of $TiO_2$ to $CeO_2$ is 1: (1-3).

8. The hot-dip cast aluminum alloy of claim 1, wherein the mass percentage of said components is as follows: Zn 41-51%, Si 1-3.2%, Mg 1.8-4%, RE 0.05-0.8%, Ti 0.05-0.35%, Ni 1.5-2.6%, and the total content of the nanometer oxide particle reinforcing agent: 0.05-0.8%.

9. A method for preparing said hot-dip cast aluminum alloy of claim 1 comprising following steps:

preparing materials according to the mass percentage of Al, Zn, Si, Mg, RE, Ti, Ni and the nanometer oxide particle reinforcing agent;

melting Al at 700-750° C. in vacuum or protective atmosphere, stirring evenly, then adding Si;

raising temperature to 800-840° C., then adding RE;

raising temperature to 830-850° C., then adding Zn;

raising temperature to 850-880° C., then adding Ni and Ti;

cooling down to 750-700° C., then adding Mg and the nanometer oxide particle reinforcing agent;

and further cooling down to 700-650° C., standing for 10-35 minutes after stirring evenly, then forming ingots by casting or die casting.

10. The method of claim 9, wherein the heating speed rate is 10-40° C/minute during said heating process, and the cooling speed rate is 20-60° C/minute during said cooling process.

11. The hot-dip cast aluminum of claim 3, wherein the specific surface of said $TiO_2$ is 20-90$m^2$/g.

12. The hot-dip cast aluminum alloy of claim 5, wherein the specific surface of said $CeO_2$ is 10-80 $m^2$/g.

* * * * *